US008756721B1

(12) United States Patent
Dewey

(10) Patent No.: US 8,756,721 B1
(45) Date of Patent: Jun. 24, 2014

(54) TOILET WITH BUILT-IN PLUNGER

(76) Inventor: Ryan Dewey, Valencia, PA (US)

( * ) Notice: Subject to any disclaimer, the term of this patent is extended or adjusted under 35 U.S.C. 154(b) by 330 days.

(21) Appl. No.: 13/434,815

(22) Filed: Mar. 29, 2012

Related U.S. Application Data

(60) Provisional application No. 61/468,944, filed on Mar. 29, 2011.

(51) Int. Cl.
*E03D 3/10* (2006.01)
*E03D 9/00* (2006.01)

(52) U.S. Cl.
USPC ..... 4/361; 4/255.01; 4/255.02

(58) Field of Classification Search
CPC ..... E03D 9/00; E03D 3/10
USPC ..... 4/361, 362, 328, 354, 255.01–255.11
See application file for complete search history.

(56) References Cited

U.S. PATENT DOCUMENTS 1,232,767 A * 7/1917 Camfield et al. ..... 4/425
1,861,899 A * 6/1932 Beach, Jr. ..... 4/255.04
3,820,754 A * 6/1974 Caron et al. ..... 251/38
5,852,834 A 12/1998 Harvey
5,963,994 A 10/1999 Harvey
6,279,176 B1 * 8/2001 Aviles ..... 4/354
6,357,057 B1 3/2002 Krist
6,457,187 B1 * 10/2002 Andersson et al. ..... 4/359
6,467,101 B1 * 10/2002 Artola ..... 4/354
6,662,381 B1 12/2003 Powell et al.
6,907,622 B2 6/2005 Rasaei et al.
7,975,324 B2 * 7/2011 Ge et al. ..... 4/326
8,418,275 B1 * 4/2013 Dondurur et al. ..... 4/255.04
2006/0059610 A1 3/2006 Conant
2008/0244819 A1 10/2008 Meador
2009/0211008 A1 8/2009 Fucito
2013/0139308 A1 * 6/2013 Dondurur et al. ..... 4/255.04

* cited by examiner

*Primary Examiner* — Huyen Le
*Assistant Examiner* — Christine Skubinna
(74) *Attorney, Agent, or Firm* — Ronald Law Group, LLC; Carl A. Ronald

(57) ABSTRACT

An improvement on a conventional toilet having a built-in plunger has a tank portion that contains a housing having a plunger apparatus and a bowl portion having a bowl, an outlet drain and one or a plurality of channels for transporting plunged water from the plunger apparatus in the tank to one or a plurality of locations in the outlet drain in order to clear a clog.

9 Claims, 2 Drawing Sheets

TOILET WITH BUILT-IN PLUNGER

CROSS-REFERENCE TO RELATED APPLICATIONS

This application claims priority of U.S. Provisional Application Ser. No. 61/468,944, filed Mar. 29, 2011.

BACKGROUND OF THE INVENTION

1. Technical Field

This invention relates generally to an improved toilet with the capability of removing clogs from drains, without any additional equipment and more particularly to a toilet with a built-in toilet plunging apparatus.

2. Background of the Invention

Conventional toilets most commonly rely on the natural downward pressure of water caused by gravity to flush a toilet effectively. The act of flushing causes water to be released from an elevated tank into the toilet bowl. This additional water then increases water pressure on the drain and siphon area, which, in turn, causes the contents of the bowl to be forced down the sewer drain. When that outlet becomes clogged, however, the additional water from the tank is added to the bowl until, in some cases, it overflows. Toilet overflow is not only unsanitary, but may cause water damage to the floor, lower level ceilings and all physical structures below the level of the toilet.

Methods for unclogging the outlet are often undesirable and consist of using a hand plunger or attempting to clear a clog by pouring more water into the bowl to dislodge the obstruction. Manually plunging a toilet is not only unsanitary, but may also cause harm to the toilet itself by damaging the pipes and seal. Further, it is often the case that the manual plunger has not been used for quite a while and cannot be easily located, which is a problem with an overflowing toilet. A second common and equally undesirable method includes pouring water into the bowl to soften up the obstruction and apply pressure, which eventually pushes the material through the drain. This method is neither reliable nor efficient and is often impractical.

Toilets with built-in mechanisms used to push through or dislodge blockages are known in the art. Such devices typically take two forms; in the first instance, prior art teaches a toilet apparatus wherein the lid forms a seal with the toilet bowl. Pumping air into the sealed toilet bowl, manually or by means of a compressor, forces the contents of the toilet bowl down the sewer pipe. It can be imagined, however, that use of such a method could lead to undesired and explosive results. In the second instance, prior art teaches a toilet with a powered automated plunging apparatus that is always resident in the bowl. Such a plunging device has several disadvantages, including the need for a power source, as well as the need for motors, electrical conduit, and other parts that can corrode in the presence of water over time and fail.

In view of the forgoing, a need has been recognized to improve upon current art to create a toilet with a built-in plunger device that minimizes the chance of malfunction, yet eliminates the need for an external plunger in order to facilitate progression of the blocking contents through to the sewer drain, all while avoiding contamination and damage to the surrounding area and other toilet components.

BRIEF SUMMARY OF THE INVENTION

In light of the background mentioned previously, it is the objective of the present invention to provide a toilet with a built-in plunging mechanism that requires no electrical power or motors to operate and does not rely on the necessity of a hermetically sealed bowl to operate properly. These, and other objects, features and advantages of the invention, are provided by a conventional toilet having a built-in plunger in the tank portion of the toilet. The built-in plunger is comprised of a valve tower vertically disposed in the tank portion over a valve tower drain, the valve tower drain being in fluid communication with the outlet drain from the bowl. Within the valve tower is a housing having an opening on a bottom surface and a plunger apparatus slidably disposed within the housing and a check valve disposed on the housing opening, the plunger apparatus also being selectively vertically lockable. The inlet tube delivering water from a water supply has a valve, such as a petcock valve, disposed thereon for directing water from the inlet tube to a plunger water line, which is connected to the valve at a first end and to the housing in a location between the plunger apparatus and the bottom surface of the housing at a second end. When actuated by the user, the plunger apparatus can be used to force water into the outlet drain through one or a series of channels in order to clear a clog.

DETAILED DESCRIPTION OF THE SEVERAL VIEWS OF THE DRAWING

The present invention will now be described more fully with reference to the accompanying drawings, in which a preferred embodiment is shown. This invention, however, maybe embodied in many different forms and should not be construed as limited to the embodiment set forth in this document. Rather, this embodiment is provided so that this application will be thorough and complete, and will convey the full scope of the invention to those skilled in the art. Like numbers refer to the same elements throughout the figures.

Figure 1:
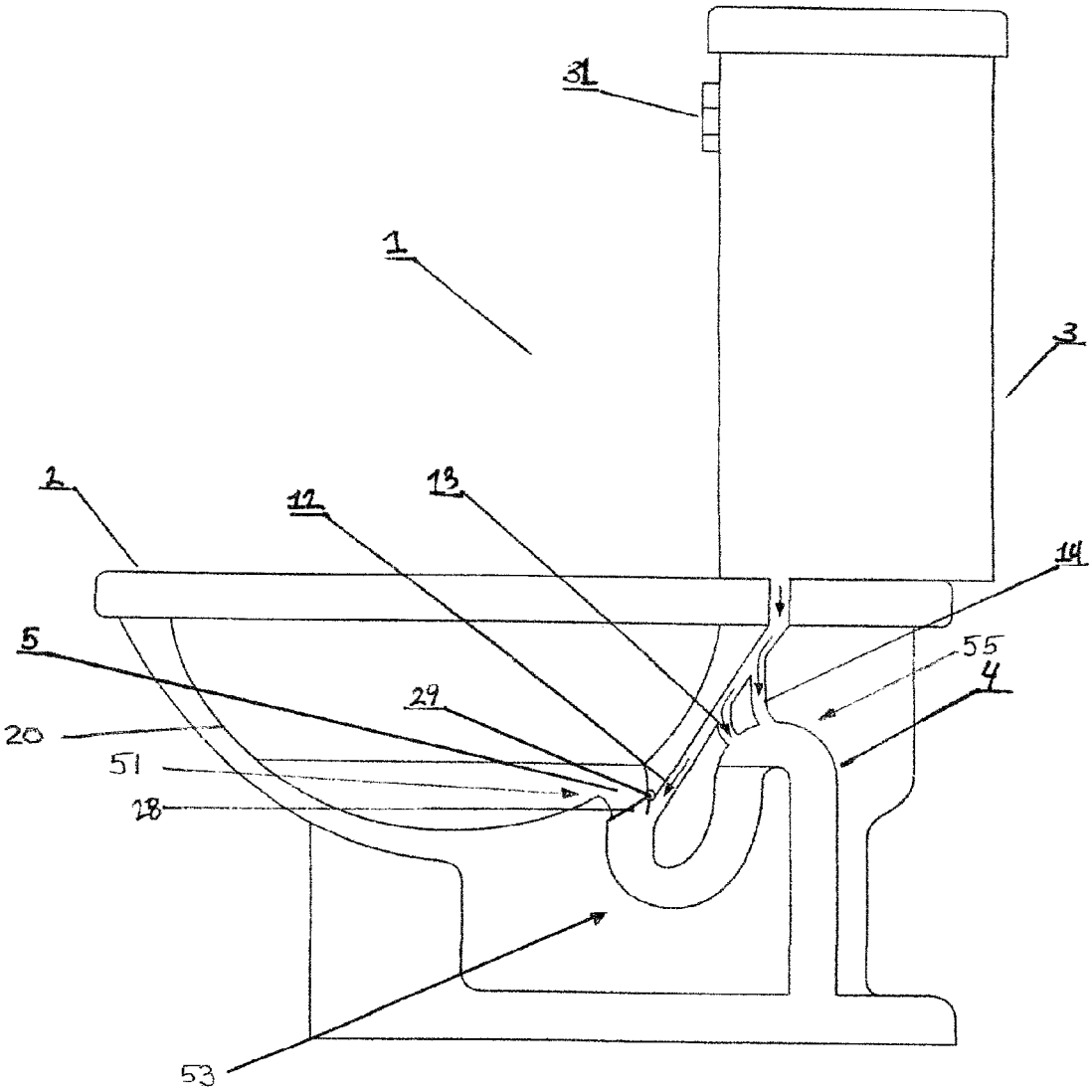
FIG. 1 broadly illustrates a sectional side profile of a toilet embodiment of the invention, toilet tank and bowl, wherein the drain flap is in the closed position for plunging, and the directional flow of water from the tank into the bowl is illustrated by arrows.

A toilet in accordance with the preferred embodiment of the present invention is shown in FIG. 1 and generally indicated by the number 1. The device is capable of containing a built-in plunging apparatus, however, the principles of the invention may be applied to other systems similarly situated.

Figure 2:
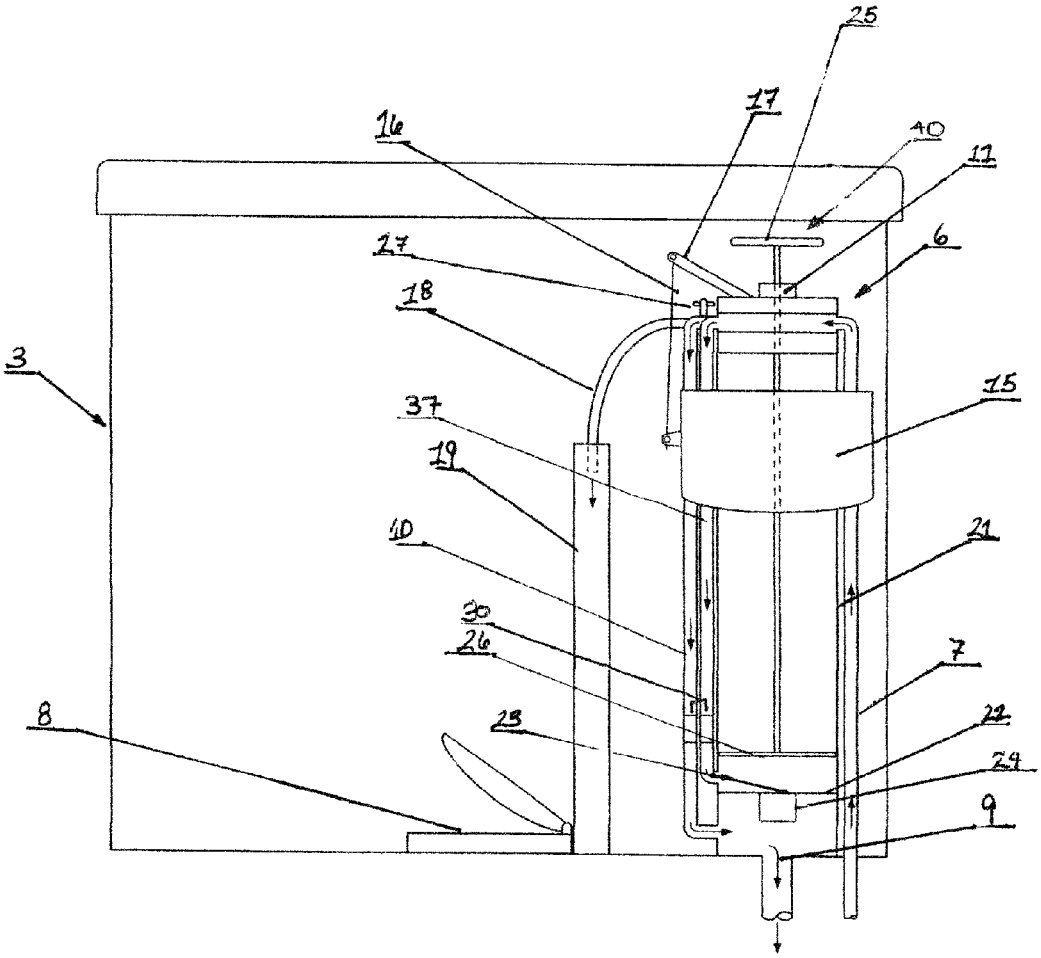
FIG. 2 broadly illustrates a sectional back view of the toilet tank containing both the modified flushing and plunging apparatus, and illustrates the directional flow of water through the toilet tank components with arrows.

Referring generally to FIGS. 1 and 2, the toilet 1 generally includes a bowl portion 2 and a tank portion 3. As is typical in prior art toilets, the bowl portion 2 has a bowl 20 and an "S" shaped outlet drain 4 disposed through the opening in the bottom of the bowl 20 which drains to a sewer pipe.

Within the tank portion 3 is the valve tower 6, which, in a presently preferred embodiment, is cylindrical. When not being flushed, both the tank portion 3 and the bowl 2 contain water, supplied by an inlet tube 7 that is connected to an external water source at a first end and, at the other end, is controlled by a main valve 11 located at the top of the valve tower 6. In use, the toilet is flushed in the conventional manner: the user activates an external lever 31 on the outside of the tank portion 3, causing a flush valve 8, located at the bottom of the tank portion 3 between the tank portion 3 and the bowl portion 2, to open, which then permits the water in the tank portion 3 to rush into a flush drain (not shown) which ultimately ends at the bowl 20.

The flushing process is assisted by a valve tower drain 9 located at the bottom of the valve tower 6 and supplied by a second water line 10 that runs from the main valve 11. The second line 10 moves water down the valve tower 6 to the valve tower drain 9 which, preferably, branches into three channels in the bowl portion 20 before connecting to the "S" shaped outlet drain 4. In a preferred embodiment, a first channel 12 empties into the a part of the "S" shaped drain outlet 4 closest to the bottom of the bowl 20; a second channel 13 and a third channel 14 empty into the outlet drain 4 further away from the bowl 20. It will be clear, to those of skill in the art, that a different number of channels may work just as well in certain configurations.

The valve tower 6, located within the toilet tank 3, is encircled by a concentric float 15. The float 15 is connected to the valve arm 17 via a rigid connector 16, which controls the main valve 11 running through the valve tower 6. When the water of the toilet tank 3 rushes into the bowl 20 as a result of flushing, the float 15 drops with the water level in the tank and pulls the valve arm 17 in a parallel downward motion that causes the main valve 11 to open. When the main valve 11 is opened, the filler tube 18 supplies water to the tank 3 through an overflow tube 19 located adjacent to the valve tower 6 and the flush valve 8 until the float 15 once again moves up the valve tower 6 with the water level and causes the valve arm 17 to force the main valve 11 to close once again.

The plunger apparatus 40 is contained within the toilet tank 3 and, in a preferred embodiment, is mostly located in a cylindrical housing 21 concentrically placed within, and making up a portion of, the valve tower 6. The base 22 of the cylindrical housing is positioned above the valve tower drain 9 and has an opening on the bottom surface 23 fitted with a check valve 24. The plunger apparatus 40 consists primarily of a plunger handle 25, which extends vertically above the valve tower 6 and down through the cylindrical housing and terminates at a circular plunger disk 26 that snugly and slidably fits within the cylindrical housing 21 in a horizontal orientation parallel to the bottom surface 23. A plunger water line 37 from the main valve 11 runs down the outside of the valve tower 6, generally parallel to the second line 10 in order to optionally deliver water to the cylindrical housing 21 below the circular plunger disk 26. When the plunger apparatus 40 is not in use, the handle 25 is positionally secured and inoperative.

When the toilet needs to be unclogged, the user removes the lid to the tank for access and twists the plunger handle 25 in a counter-clockwise direction to release it from threading or a set of tabs or some other mechanism by which the handle can be kept in position until needed as is known in the art (not shown). Once the plunger handle 25 is released, the user closes a petcock valve 27, which cuts off the water supply to the filler tube 18 and the second line 10. In one embodiment, the petcock valve 27 has an elongated handle (not shown) that mechanically pushes the valve arm 17 down when the petcock valve 27 is closed. This, in turn, keeps water running from the main valve 11 through the third line 37 and causes water to fill the space between the bottom of the cylindrical plunger housing 21 and the circular plunger disk 26. As the water fills the cylindrical plunger housing 21, the circular plunger disk 26 and the plunger handle 25 are pushed upward in the cylindrical housing 21 by the force of the water. When the plunger housing 21 is full and the handle 25 stops rising, the user pushes the plunger handle 25 downward forcefully, which pushes the water from the plunger housing 21 through the check valve 24 and into the valve tower drain 9 at the bottom of the tank. All three of the channels 12, 13, 14 deliver the forced water to three different places in the "S" shaped outlet drain 4 in order to clear any material blocking the pipe and unclog the toilet. It is expect that the valve tower drain and the one or a plurality of channels are cored or hollowed out of the bowl portion of the toilet after manufacture or are formed in the bowl portion during initial manufacture. For purposes of description, the "S" shaped outlet drain has a drain entrance 51, a first lower curve 53 and a second upper curve 55. Check valves 30 on the second 10 and third 37 lines prevent backflow of water into the toilet tank.

Referring to FIG. 1 again, in order to prevent water pressure from backing into the bowl 2, the bowl opening 5 is sealed by a flap 28 located between the bowl 2 and the "S" shaped outlet 4. Water pressure from a plunging event as describe above pushes the flap 28 closed; however, in an alternative embodiment, a flap handle 29 can extend outside the bowl in order to facilitate manual opening and closure.

While the invention has been described with respect to a certain specific embodiment, it will be appreciated that modifications and changes may be made by those skilled in the art without departing from the spirit of the invention. In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

I claim:

1. A toilet with a built-in plunger comprising a bowl portion having a bowl and an outlet drain;

a tank portion for receiving a volume of water from an inlet tube and holding said volume of water in an elevated position relative to the bowl, said tank portion having a flush valve in fluid communication with the bowl, whereby opening the flush valve causes the volume of water to rapidly enter the bowl; said tank portion further having a valve tower vertically disposed over a valve tower drain, the valve tower drain being in fluid communication with the outlet drain;

a housing disposed within the valve tower, the housing having an opening on a bottom surface;

a plunger apparatus slidably disposed within the housing and a check valve disposed on the housing opening, said plunger apparatus being selectively vertically lockable;

a valve disposed on the inlet tube for directing water from the inlet tube to a plunger water line, said plunger water line connected to the valve at a first end and to the housing in a location between the plunger apparatus and the bottom surface of the housing at a second end;

whereby the plunger apparatus may be actuated by a user to force water into the outlet drain to clear a clog.

2. The toilet of claim 1, wherein the valve tower drain further branches into a plurality of channels that all connect to the outlet drain.

3. The toilet of claim 2, wherein the plurality of channels connect to the outlet drain at different points on the outlet drain.

4. The toilet of claim 1, wherein the outlet drain further comprises a drain entrance, a first lower curve and a second upper curve.

5. The toilet of claim 4, further comprising a closeable flap near the drain entrance, said flap being selectively operable for blocking backflow from the drain into the bowl.

6. The toilet of claim 4, wherein the valve tower drain further branches into a first channel, a second channel and a third channel.

7. The toilet of claim 6, wherein the first channel connects to the outlet drain between the drain entrance and the first lower curve, the second channel connects to the outlet drain between the first lower curve and the second upper curve and the third channel connects to the outlet drain in the area of the second upper curve.

8. The toilet of claim 1, wherein the housing is concentric with the valve tower.

9. The toilet of claim 1, wherein the plunger apparatus is comprised of a plunger handle disposed vertically on a plunger disk, said plunger disk slidably and snugly horizontally fitted into the cylindrical housing.

* * * * *